US005537762A

United States Patent [19]

Walters

[11] Patent Number: 5,537,762

[45] Date of Patent: Jul. 23, 1996

[54] DYNAMIC ATHLETIC SHOE SOLE

[76] Inventor: William D. Walters, 2230 Biscay Ct., Byron, Calif. 94514

[21] Appl. No.: 303,639

[22] Filed: Sep. 9, 1994

[51] Int. Cl.[6] ..... A43B 13/18

[52] U.S. Cl. ..... 36/28; 36/29; 36/3 R; 36/3 B

[58] Field of Search ..... 36/28, 29, 30 R, 36/35 R, 37, 114, 35 B, 3 R, 3 B, 102

[56] References Cited

U.S. PATENT DOCUMENTS

| | | | |
|---|---|---|---|
| 4,187,620 | 2/1980 | Selner | 36/28 |
| 4,223,455 | 9/1980 | Vermeulen | 36/3 B |
| 4,274,211 | 6/1981 | Funck | 36/29 |
| 4,462,171 | 7/1984 | Whispell | 36/29 |
| 4,616,431 | 10/1986 | Dassler | 36/28 |
| 4,670,995 | 6/1987 | Huang | 36/3 B |
| 4,763,426 | 8/1988 | Polus | 36/3 B |
| 5,025,575 | 6/1991 | Lakic | 36/29 |
| 5,158,767 | 10/1992 | Cohen | 36/114 |

FOREIGN PATENT DOCUMENTS

| | | | |
|---|---|---|---|
| 0012518 | 11/1990 | WIPO | 36/28 |
| 2003069 | 3/1992 | WIPO | 36/28 |

*Primary Examiner*—Paul T. Sewell
*Assistant Examiner*—Marie Denise Patterson

[57] ABSTRACT

A dynamic athletic shoe sole wherein a composite sole is provided with dynamic air cylinders for cushioning the alternate weighting and unweighting of the athletic shoe by a wearer's walking or running.

16 Claims, 4 Drawing Sheets

DYNAMIC ATHLETIC SHOE SOLE

BACKGROUND OF THE INVENTION

1. Field of the Invention

The present invention relates to athletic shoe soles and, more particularly, to a dynamic sole that includes hydraulic pistons for cushioning the alternating weighting and unweighting of the shoe by the wearer.

2. Description of the Prior Art

There are several shoe soles that include trapped air pockets which cushion the weighting and unweighting of the shoe during the wearer's walking or running. The sizes of the air pockets can vary from those which include air bubbles of minuscule size as occur naturally in foam, plastic, or rubber to large capsules which can also be formed in foam materials during their creation by the choice of ingredients. Even larger cavities can be created by molds or the deletion of center portions in multilayered materials. The prior art of athletic shoes further includes soles that contain compartments with variable or fixed internal pressures which can be pumped up with pressurized air or gas from internal or external pumps.

SUMMARY OF THE INVENTION

The present invention is an athletic shoe sole comprising a flexible tread layer having a patterned ground or floor-engaging lower surface, an encircling peripheral lateral edge, and a platform supporting upper surface. The tread layer includes a multiplicity of cylindrical cavities formed therein distributed in a balanced pattern with respect to a longitudinal axis of the shoe sole. The cylindrical axis of the cavities is disposed vertically and the upper ends of the cavities are open and tile lower ends thereof are closed. The platform supporting upper surface of the tread layer is formed for mating with and supporting an integrated layer of the sole which the wearer of the shoe stands upon. A container rim for the tread layer is formed for securement to both tile peripheral edge of the tread layer and to the lower peripheral edge of an athletic shoe body The container rim includes an integrated layer comprising a sculptured upper surface, formed to conform to and support the bottom of the foot of a wearer, and a lower platform surface formed from a relatively rigid material for mating with the upper surface of the tread layer. The lower platform surface includes cylindrical projections which extend part-way into the cavities of the tread layer forming pistons therein and trapping air between the lower ends of the cavities and the lower ends of the pistons. The container rim also includes a compressible filler material extending between the sculptured upper surface and the platform lower surface and binds them together forming an integrated layer, integral to the container rim, which the wearer of tile shoe stands upon. The container rim also includes a skirt which is secured to and depends from the peripheral edge of the integrated layer and surrounds and is secured to the peripheral edge of the tread layer. The skirt binds the integrated layer to the tread layer at the peripheral edges of both whereby the integrated layer can reciprocate with respect to the tread layer as the weight of the shoe wearer is alternately imposed on and removed from the integrated layer, thereby alternately compressing and relaxing the pressure on the air trapped between the pistons formed on the integrated layer and the bottoms of the cavities of the tread layer.

OBJECTS OF THE INVENTION

It is therefore an important object of the present invention to provide an improved athletic shoe sole which utilizes variable volume cavities of compressible air for supporting the weight of the shoe wearer.

It is another object of the present invention to provide a shoe sole in which two interconnected but independent portions of the sole cooperate and interact in a dynamic relationship to provide a cushioning effect during walking and running to the wearer of the shoe.

It is a further object of the present invention to provide a new method of construction for an athletic shoe sole which can be assembled from layers to provide cylinders and pistons wherein air is captured and can be compressed by the: dynamic interaction of the layers of the sole.

It is still another objection of the present invention to provide an athletic shoe sole in which captured air pockets can be compressed in a piston and cylinder arrangement rather than simply deforming an air cavity encased in a shoe sole construction.

And it is yet a further object of the present invention to provide a shoe sole construction providing reciprocating pistons and cylinders that can be assembled from different types of preferred materials for ease of construction, long service life, and economical cost.

Other objects and advantages of the present invention will become apparent when the apparatus of the present invention is considered in conjunction with the accompanying drawings.

DESCRIPTION OF THE PREFERRED EMBODIMENT

Reference is made to the drawings for a description of the preferred embodiment of the present invention wherein Like reference numbers represent Like elements on corresponding views.

Figure 1:
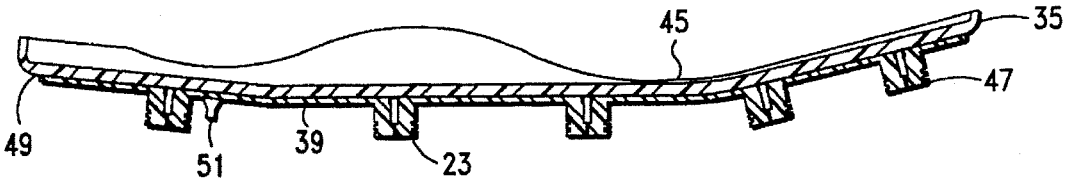
FIG. 1 is a side elevation in cross-section of the integrated layer of the container rim of the improved athletic shoe sole of the present invention.
Figure 2:
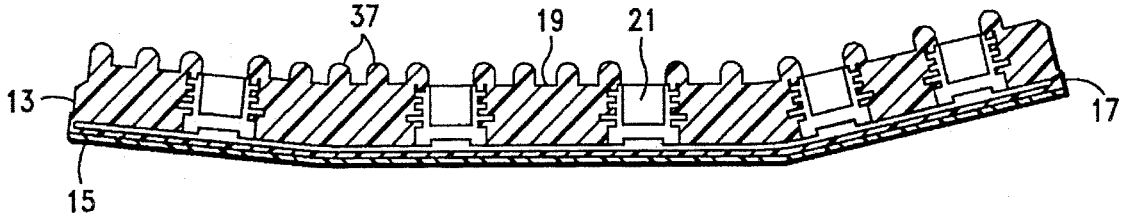
FIG. 2 is a side elevation in cross-section of the flexible tread layer of the improved athletic shoe sole of the present invention.
Figure 3:
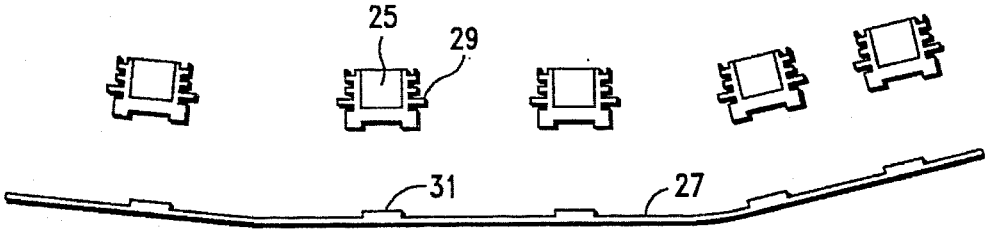
FIG. 3 is an exploded view in side elevation and cross-section of the flexible plastic plate embedded in the tread layer and the plastic cylinder inserts which are secured thereto.
Figure 4:
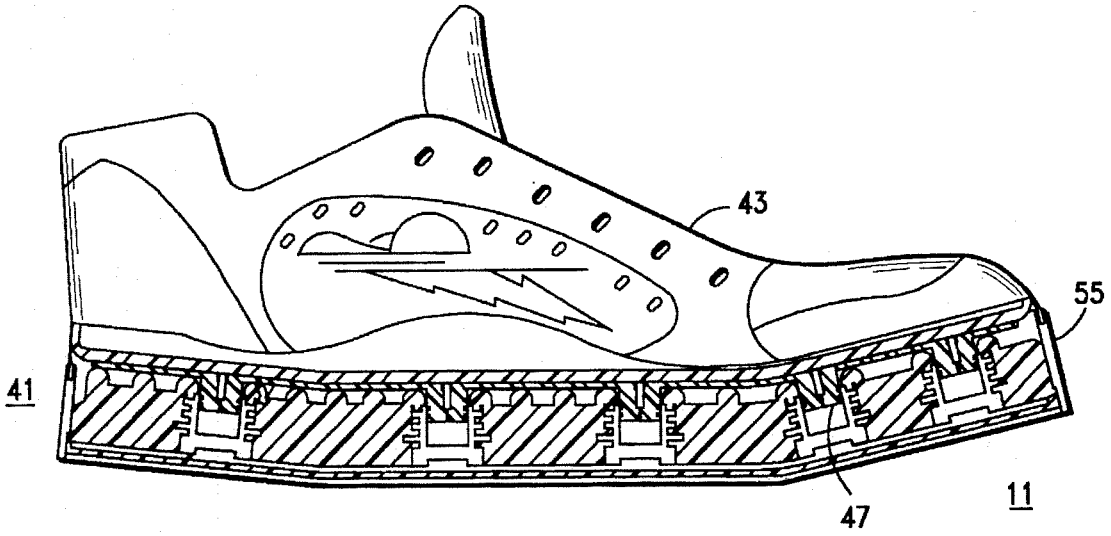
FIG. 4 is a side elevation in partial cross-section showing the assembled improved athletic shoe sole of the present invention secured to the lower peripheral edge of an athletic shoe body.

FIGS. 1–4 illustrate a first preferred embodiment of the improved athletic shoe sole of the present invention. FIG. 1 illustrates a layer of the shoe sole which is fitted into the layer illustrated in FIG. 2. FIG. 3 is an exploded view of elements which are molded into the layer illustrated by FIG. 2. FIG. 4 illustrates the assembled athletic shoe sole of the present invention. Reference is made to the embodiment of the invention shown in FIGS. 1–4. There shown is an athletic shoe sole 11 comprised of numerous interconnected layers, two of which reciprocate with respect to each other in a dynamic relationship.

Illustrated in FIG. 2 is a flexible tread layer 13 having a patterned ground or floor engaging lower surface 15 which constitutes the bottom or outsole of the shoe. The tread layer provides both traction and support to the wearer's foot. It is defined by an encircling peripheral lateral edge 17 and a platform supporting upper surface 19 as well as the surface engaging lower outsole.

A multiplicity of dead ended cylindrical cavities 21 are formed in the tread layer 13 and are distributed in a balanced pattern with respect to the longitudinal axis of a shoe sole. The cylindrical cavities contain reciprocable pistons 23 when other layers of the sole are integrated with the tread layer. The cylindrical axes of the cavities are disposed vertically with the upper ends of the cavities being open and the lower ends being closed.

Figure 10:
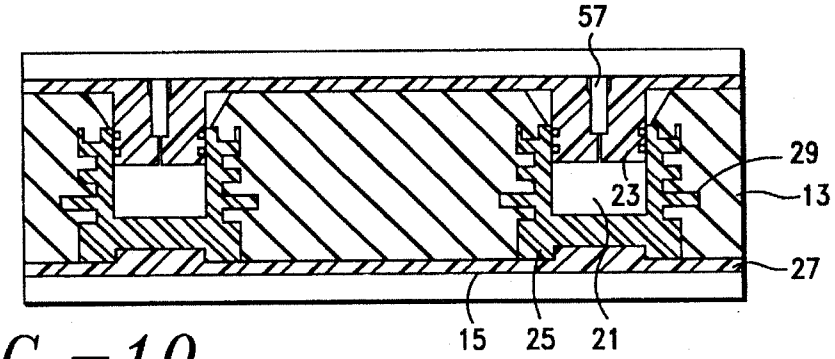
FIG. 10 is a broken-out section taken along Line 10—10 of FIG. 8 illustrating the dual piston assemblies located at the bottom of the foot of the improved athletic shoe sole of the present invention.
Figure 8:
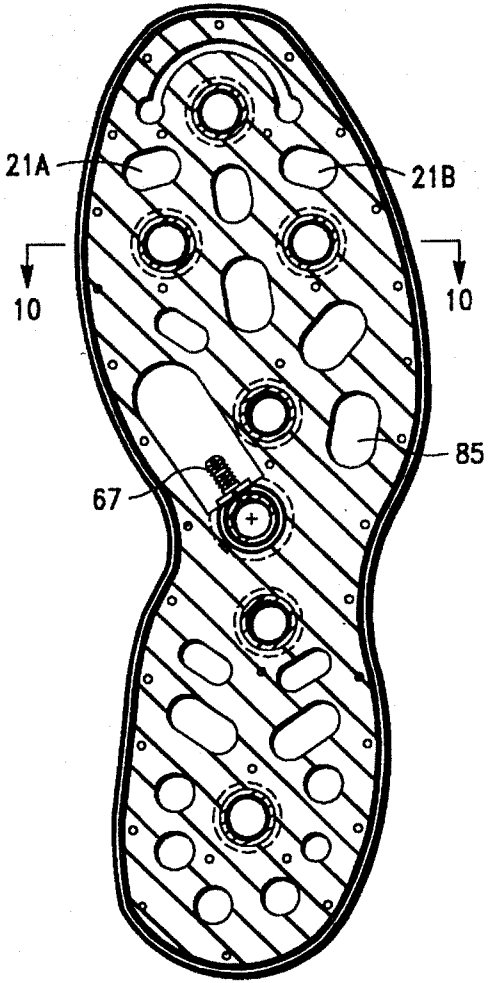
FIG. 8 is a top plan view illustrating the lower sole of an alternative embodiment of the athletic shoe sole construction of the present invention including an air pump.
Figure 11:
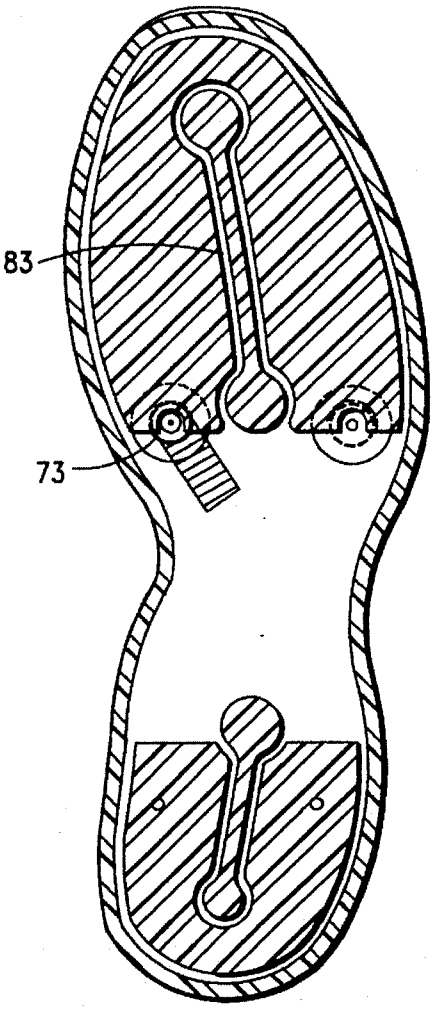
FIG. 11 is a top plan view in cross-section of the upper sole and cushions that mate with the lower sole of FIG. 8.
Figure 12:
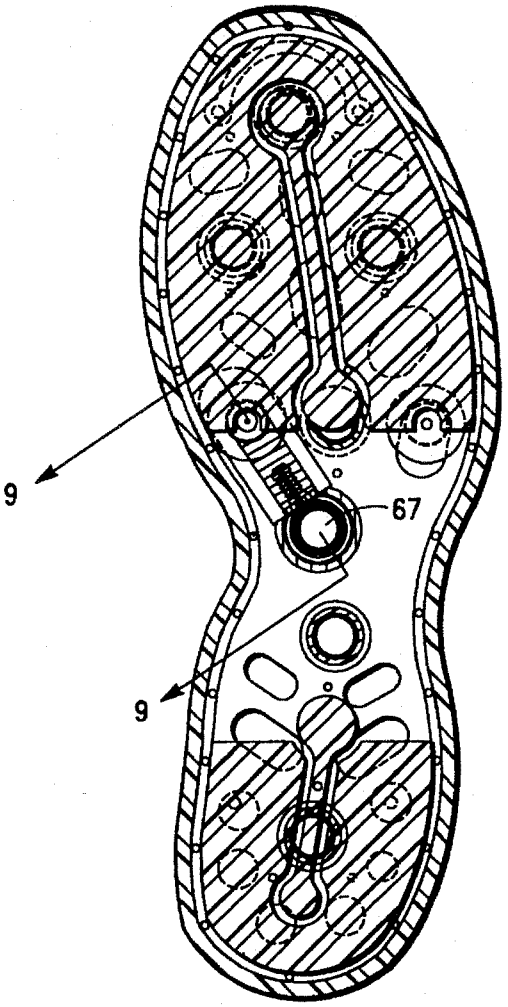
FIG. 12 is a top plan view in partial section illustrating FIG. 11 assembled on top of FIG. 8 in the assembled configuration of the alternative embodiment of the improved athletic shoe sole of the present invention.

Reference is made to FIGS. 8 and 10. In the preferred embodiment of the invention, a pair of cavities 21A and 21B are located proximate the ball of the wearer's foot disposed a balanced distance on opposite sides of the longitudinal axis of the sole while the remaining cavities are located along the axis. The longitudinal axis of the sole is not necessarily the center line of the shoe sole, especially in the area of the ball of the foot, but the axis along which the weight of the foot is distributed which runs in a slight curve generally doom the center of the sole of the shoe. Obviously, more cavities could be included in a balanced pattern along the axis if more piston cylinders are deemed desirable.

Reference is made again to FIGS. 1–4 and 10. The tread layer 13 is formed of a molded rubberized plastic or durable foam rubber while the cylindrical cavities 21 formed in the tread layer can be comprised of hard plastic cylinder inserts 25 which are embedded in the tread layer during the molding process. The inserts are illustrated in the FIGS. in side elevation cross-section without cross-section lines for clarity. The same is true of the plastic layer 27 to which they are attached. The plastic inserts can include a plurality of flanges 29 for stabilizing the inserts in the tread layer.

In a preferred form of construction, the tread layer 13 includes a flexible plastic plate 27 having a multiplicity of locators 31 formed thereon for engaging the plastic cylinder inserts 25 at the proper positioning on the plate. The inserts includes a means for engaging the locators. The locators illustrated in the FIGS. are cylindrical projections which fit into cylindrical receptacles formed in the bottom of the inserts. The mating configurations could be designed with a force fit or the inserts glued onto the plate for the further molding process. Likewise, the mating configurations could be other male and female forms and the male configuration formed on the insert to fit into holes in the plate. The assembled plate and attached inserts are then molded into a resilient elastomeric plastic to form the tread layer.

The platform supporting upper surface 19 of the tread layer 13 is formed for mating with mid supporting an integrated layer 35 of the shoe sole 11 which the wearer of the shoe stands upon. The upper surface of the tread layer deforms and is energy absorbing and provides a partial cushion to the integrated layer as the pistons 23 which are attached to the integrated layer and reciprocate in the cylindrical cavities 21 are actuated. For this purpose, the upper surface of the preferred embodiment of the tread layer is provided with a multiplicity of deformable projections 37 which support tile relatively rigid bottom surface 39 of the integrated layer disposed above it. The projections provide a cushioning effect to the downward movement or compression effect of the integrated layer on the tread layer as a result of the shoe wearer's weight being imposed thereon.

A container rim 41 for the tread layer is formed for securement both to the peripheral lateral edge 17 of the tread layer 13 and to the lower peripheral edge of an athletic shoe upper 43 or body which surrounds the upper portions of the foot of the wearer. The container rim includes the integrated layer 35 which is comprised of a sculptured upper surface 45 formed to support the bottom of the wearer's foot. The material forming the sculptured upper surface of a shoe sole is normally called a last in a traditional shoe. The lower platform surface layer 39 of the integrated layer of the present invention is formed from a relatively rigid plastic material for mating in opposed abutting relation with the upper surface 19 of the tread layer, but the integrated layer and the tread layer are not glued together: they reciprocate with respect to each other in a dynamic relationship. The lower platform surface layer includes cylindrical projections 23 which project downward and extend part way into the cavities 21 of the tread latter forming pistons therein. The projections trap air between the lower ends of the cavities in the tread layer and the lower ends of the pistons of the integrated layer. The pistons include deformable sealing rings 47 seated in piston ring type grooves formed on said piston/projections.

A slightly compressible plastic foam material 49 forms the sculptured upper surface 45 of the integrated layer 35 which the wearer of the shoe stands upon and it is bound to the platform lower surface layer 39. In a preferred form of the invention, the foam material last is provided with positioning means which engage the lower platform surface and maintain the physical positioning between the two surfaces. One form of positioning means includes a multiplicity of male projections 51 formed on the last layer 45/49 and engage female receptacles formed in the lower platform surface layer. Alternatively, the two layers could be glued together to form the integrated layer 35. The integrated layer is integral to the container rim 41 by being secured by its lateral peripheral edge to a skirt 55.

The upper edge of the skirt 55 of the container rim 41 is secured to the shoe body or upper 43 while the lower edge of the skirt depends from the peripheral edge of the integrated layer 35 and surrounds and is secured to the peripheral lateral edge 17 of the tread layer 13. The skirt binds the integrated layer to the tread layer at the peripheral edges of both whereby the integrated layer can reciprocate vertically with respect to the tread layer in the dynamic relationship. This occurs as the weight of the shoe wearer is alternately imposed on and removed from the integrated layer thereby alternately compressing and relaxing the pressure on the air trapped between the pistons 23 of the integrated layer and the bottoms of the cavities of the tread layer. However, the skirt prevents the tread layer from moving laterally with respect to the integrated layer.

Reference is made to FIG. 10. A valve means is provided for releasing air from the cylindrical cavities 21 in the tread layer 13 during mating of the tread layer with the integrated layer 35 so that the pistons 23 can be fitted into the cavities. One means is effected by providing ducts 57 through the piston projections on the integrated layer whereby when the integrated layer is fitted to the tread layer, and the pistons forced into the cavities, air escapes until the proper relationship of piston depth in the cavities is achieved. The air ducts are then filled with a sealing compound.

Figure 5:
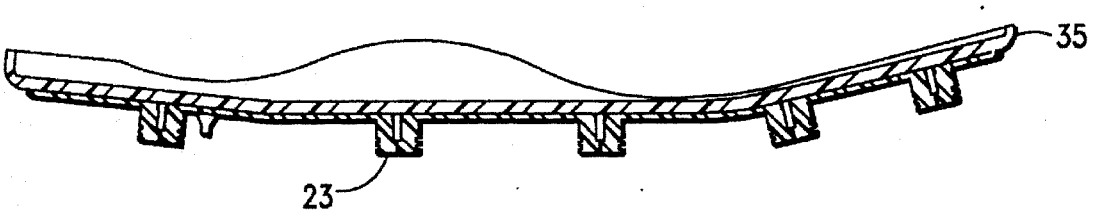
FIG. 5 is essentially identical to FIG. 1 and serves the same purpose.
Figure 7:
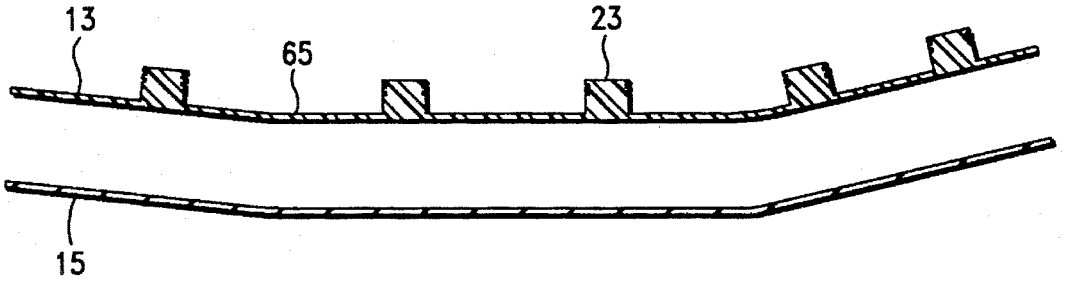
FIG. 7 is an exploded view similar to FIG. 3 Illustrating the alternative form of construction of a component of the athletic shoe sole which mates with the tread layer of FIG. 6.

Reference is made to FIGS. 5 and 7 which illustrate an alternative preferred embodiment of the invention for creating the layers of the shoe sole for a different method of construction. The flexible tread layer of the first embodiment is comprised of slightly different separate layers rather than being molded as one piece. A flexible foam intermediate layer 59 having platform supporting upper and lower surfaces 61, 63 similar to the top surface 33 of the tread layer 13 of the first preferred embodiment of the invention, is provided with a multiplicity of cylindrical cavities 21 formed therethrough. The platform supporting upper and lower surfaces of the intermediate layer are formed for mating with and supporting both an upper integrated layer 35 of the sole, which the shoe wearer stands upon, and a lower separate tread layer 13 which engages the floor or ground.

A container rim for the intermediate layer 59 has an integrated layer 35 as in the first embodiment and is formed for securement to the peripheral edges of both the intermediate layer and the separate tread layer 13 as well as the lower peripheral edge of the athletic shoe body or upper. The separate tread layer, while it is cushioned by the lower surface 63 of the intermediate layer, unlike the integrated layer, is secured to the intermediate layer and has a patterned ground or floor engaging lower surface 15. The tread layer of the second embodiment is provided with an upper surface 65 which is the mirror image of the lower surface of the integrated layer whereby the cylindrical cavities 21 in the intermediate layer are closed at the bottom ends by the projections 23 on the tread layer when it is secured to the intermediate layer.

A skirt 55 in the second preferred embodiment, which depends from the peripheral edge of the integrated layer 35, forming the container rim 41, surrounds and is secured to the peripheral edge of the intermediate layer 59 and binds the integrated layer to the intermediate layer at the peripheral edges of both, whereby the integrated layer can reciprocate with respect to the intermediate layer instead of with respect to the tread layer as with the first preferred embodiment.

Figure 6:
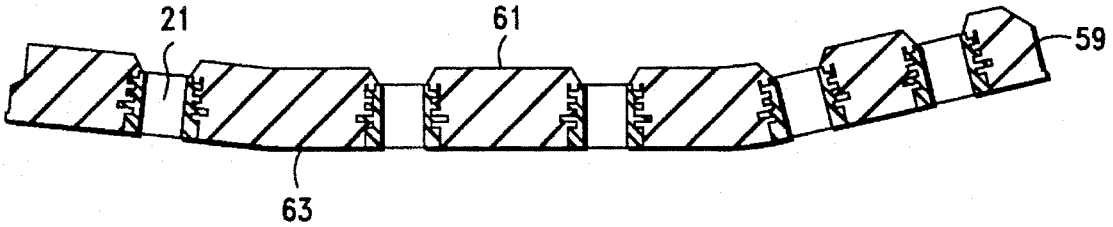
FIG. 6 is an alternative embodiment of FIG. 2 for an alternative form of athletic shoe sole construction of the present invention.
Figure 9:
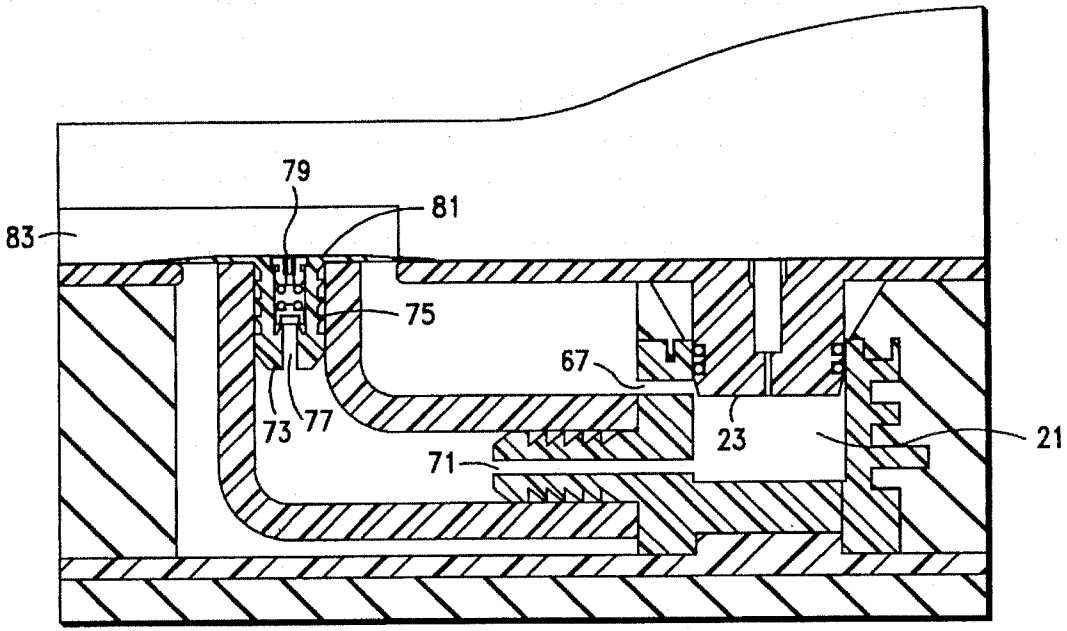
FIG. 9 is a broken-out section taken along line 9—9 of FIG. 12 showing the air pump of the alternative embodiment illustrated in FIG. 8.

Reference is made to FIGS. 8–12 of the drawings which illustrate a third embodiment of the invention employing an internal air pump which circulates air in the sole 11 in response to the weighting and unweighting of the sole by the shoe wearer. Illustrated in FIG. 9 is an air pump which supplies air in a closed circuit to air channels and cavities in the integrated layer illustrated in FIG. 6. The air pump includes a piston 23 and cylinder 21 similar to those described for the first preferred embodiment of the invention. However, it includes an air inlet 67 disposed near the top of the piston cylinder and an air outlet 71 disposed near the bottom of the cylinder.

A one-way valve 73 is disposed on the high pressure side of the air pump 67 and communicates with a closed air circuit. The valve includes a spring loaded piston 75 at the bottom of the valve which normally keeps the air inlet passage 77 to the valve closed until the spring pressure is overcome by the compressed air from the air pump. Air inletted to the valve flows out the orifice 79 In the center of the top sealing member 81 and into the closed air circuit. The valve can be mounted in any orientation whereby top and bottom as used in describing the valve are simply relative terms.

Reference is made to FIGS, 11 and 12. The air channels 83 and cavities 85 in the integrated layer 35 are disposed in a balanced pattern with respect to the longitudinal axis of the shoe sole. At least one of the piston assemblies $^{21}/_{23}$ is utilized as an air pump 67 disposed internally of the tread layer 13 for supplying air pressure in a closed circuit to the channels and cavities. The one-way valve 73 on the high pressure side of the pump supplies air to the closed circuit which distributes the air to the air chambers 85.

Thus it will be apparent from the foregoing description of the invention in its preferred form that it will fulfill all the objects and advantages attributable thereto. While it is illustrated and described in considerable detail herein, the invention is not to be limited to such details as have been set forth except as may be necessitated by the appended claims.

We claim:

1. A dynamic athletic shoe sole comprising a flexible tread layer having a patterned ground or floor-engaging lower surface, an encircling peripheral lateral edge, and a platform supporting upper surface, said tread layer including a multiplicity of cylindrical cavities formed therein and distributed in a balanced pattern with respect to a longitudinal axis of the shoe sole, the cylindrical axis of said cavities being disposed vertically and the upper ends of said cavities being open and the lower ends thereof being closed, said platform supporting upper surface of said tread layer formed for mating with and supporting an integrated layer of said sole which the wearer of the shoe stands upon, a container rim for said tread layer formed for securement to both the peripheral edge of said tread layer and the lower peripheral edge of an athletic shoe body, said container rim including an integrated layer comprising a sculptured upper surface formed to conform to and support the bottom of the foot of a wearer, a lower platform surface formed from a relatively rigid material for mating with the upper surface of said tread layer, said lower platform surface including cylindrical projections which extend part-way into the cavities of said tread layer forming pistons therein and trapping air between the lower ends of said cavities and the lower ends of said pistons, and a compressible filler material extending between and secured to both said sculptured upper surface and said platform lower surface forming an integrated layer integral to said container rim, and a skirt which 1s secured to and depends from the peripheral edge of said integrated layer and surrounds and is secured to the peripheral edge of said tread layer, said skirt binding said integrated layer to said tread layer at the peripheral edges of both whereby said integrated layer can reciprocate with respect to said tread layer as the weight of the shoe wearer is alternately imposed upon and removed from the integrated layer and thereby alternately compressing and relaxing the pressure on the air trapped between the pistons of the integrated layer and the bottoms of the cavities of the tread layer.

2. The athletic shoe sole of claim 1 wherein the cylindrical cavities formed in the tread layer include plastic cylinder inserts embedded in the tread layer.

3. The athletic shoe sole of claim 2 wherein said tread layer includes a flexible plastic plate embedded therein, said plate having a multiplicity of locators formed thereon for engaging said plastic cylinder inserts at the proper positioning thereof on said plate, said inserts including means for engaging said locators.

4. The athletic shoe sole of claim 2 wherein said tread layer is molded and said plastic inserts include a plurality of flanges for stabilizing said inserts in said layer.

5. The athletic shoe sole of claim 1 wherein the pistons of said integrated layer include deformable sealing rings seated in piston ring grooves formed on said pistons.

6. The athletic shoe sole of claim 1 wherein said integrated layer includes a last forming the sculptured upper surface, said lower platform surface is a plastic layer, and said filler is a plastic foam glued at least to said last.

7. The athletic shoe sole of claim 6 wherein said last and plastic foam are provided with positioning means which engage said lower platform surface and maintain the physical positioning between the two surfaces.

8. The athletic shoe sole of claim 1 wherein the upper surface of said tread layer is provided with deformable projections which support the bottom surface of said integrated layer and provide a cushioning effect to the downward movement of the integrated layer as a result of the shoe wearer's weight being imposed thereon.

9. The athletic shoe sole of claim 1 wherein the tread layer includes a pair of cavities located at the ball of the wearer's foot a balanced distance on opposite sides of the longitudinal axis of said sole with the remaining cavities located on said axis.

10. The athletic shoe sole of claim 1 including valve means for releasing air trapped between said pistons and the lower ends of said cavities formed in said tread layer.

11. The athletic shoe sole of claim 10 wherein said pistons are provided with air ducts which are filled with a sealing compound after the integrated layer is assembled with respect to the tread layer and the excess air has escaped.

12. The athletic shoe sole of claim 1 wherein said integrated layer includes air channels and cavities disposed in a balanced pattern with respect to the longitudinal axis of the shoe sole and at least one of said piston assemblies is utilized as an air pump disposed internally of said tread layer for supplying air pressure in a closed circuit to said channels and cavities in said integrated layer.

13. The athletic shoe sole of claim 12 wherein said piston assembly engaged with said air pump intakes air from said closed circuit and said circuit includes a one-way valve which communicates with the high pressure side of said pump.

14. The athletic shoe sole of claim 1 wherein said flexible tread layer includes a flexible foam intermediate layer having platform supporting upper and lower surfaces and a multiplicity of cylindrical cavities formed therethrough, said platform supporting upper and lower surfaces of said intermediate layer formed for mating with and supporting both an integrated layer of said sole which the wearer stands on, and a lower tread layer, a container rim for said intermediate layer formed for securement to both the peripheral edge of said intermediate layer and said tread, and to the lower peripheral edge of an athletic shoe body, said container rim including a tread layer sectored to said intermediate layer and having a patterned ground or floor-engaging lower surface, a peripheral lateral edge, and an upper surface which is the mirror image of the lower surface of said integrated layer, said tread layer being secured to said intermediate layer whereby said cylindrical cavities in said intermediate layer are closed at the bottom ends thereof by said tread layer.

15. A dynamic athletic shoe sole comprising a flexible foam intermediate layer having a peripheral lateral edge, and platform supporting upper and lower surfaces, said intermediate layer including a multiplicity of cylindrical cavities formed therethrough and distributed in a balanced pattern with respect to a longitudinal axis of the shoe sole, the cylindrical axis of said cavities being disposed vertically, said distribution of cavities includes a pair of cavities located at the ball of the wearer's foot a balanced distance on opposite sides of the longitudinal axis of said sole with the remaining cavities located on said axis, said cavities formed by plastic inserts embedded in said intermediate layer and having a plurality of flanges for stabilizing said inserts in said layer, said platform supporting upper and lower surfaces of said intermediate layer formed for mating with and supporting both an integrated layer of said sole which the wearer stands on, and a lower tread layer, said platform supporting surfaces having been provided with deformable projections which support the bottom surface of said integrated layer and the top surface of said tread layer and provide a cushioning effect to the movement of the layers as a result of the shoe wearer's weight being imposed thereon, a container rim for said intermediate layer formed for securement to both the peripheral edge of said intermediate layer and said tread, and to the lower peripheral edge of an athletic shoe body, said container rim including an integrated layer comprising a last having a sculptured upper surface formed to support the bottom of the foot of a wearer, a lower platform surface layer formed from a relatively rigid plastic material for mating with the upper surface of said tread layer mid including cylindrical projections which extend part-way into the cavities of said tread layer forming pistons therein and trapping air between the lower ends of said cavities and the lower ends of said pistons, said pistons including deformable sealing rings seated in piston ring grooves formed on said pistons, and a slightly compressible plastic foam filler glued to said sculptured upper surface layer and said platform lower surface layer binding them together forming an integrated layer integral to said container rim which the wearer of the shoe stands upon, a tread layer secured to said intermediate layer and having a patterned ground or floor-engaging lower surface, a peripheral lateral edge, and an upper surface which has cylindrical projections distributed in a mirror image of the projection on the lower surface of said integrated layer whereby said cylindrical cavities in said intermediate layer are closed as the bottom ends thereof by said tread layer, a valve means for releasing air trapped between said pistons and the lower ends of said cavities formed in said intermediate layer, a skirt which depends from the peripheral edge of said integrated layer and surrounds and is secured to the peripheral edge of said intermediate layer, said skirt binding said integrated layer to said intermediate layer at the peripheral edges of both whereby said integrated layer can reciprocate with respect to said intermediate layer as the weight of the shoe wearer is alternately imposed on and removed from the integrated layer and thereby alternately compressing and relaxing the pressure on the air trapped between the pistons of the integrated layer and the intermediate layer.

16. A dynamic athletic shoe sole comprising a flexible foam intermediate layer having a peripheral lateral edge, and platform supporting upper and lower surfaces, said intermediate layer including a multiplicity of cylindrical cavities formed therethrough and distributed in a balanced pattern with respect to a longitudinal axis of the shoe sole, the cylindrical axis of said cavities being disposed vertically, said platform supporting upper and lower surfaces of said intermediate layer formed for mating with and supporting both an integrated layer of said sole which the wearer stands upon, and a lower tread layer, a container rim for said intermediate layer formed for securement to both the peripheral edges of said intermediate layer and said tread, and to the lower peripheral edge of an athletic shoe body, said container rim including an integrated layer comprising a sculptured upper surface formed to support the bottom of the foot of a wearer, a lower platform surface formed from a relatively rigid material for mating with the upper surface of said tread layer and including cylindrical projections which extend part-way into the cavities of said tread layer forming pistons therein and trapping air between the lower ends of said cavities and the lower ends of said pistons, and a slightly compressible filler extending between said sculptured upper surface and said platform lower surface and binding them together forming an integrated layer integral to said container rim which the wearer of the shoe stands upon, a tread layer secured to said intermediate layer and having a patterned ground or floor-engaging lower surface, a peripheral lateral edge, and an upper surface which is the mirror image of the lower surface of said integrated layer whereby :said cylindrical cavities in said intermediate layer are closed as the bottom ends by said tread layer, a skirt which depends from the peripheral edge of said integrated layer and surrounds and is secured to the peripheral edge of said intermediate layer, said skirt binding said integrated layer to said intermediate layer at the peripheral edges of both whereby said integrated layer can reciprocate with respect to said intermediate layer as the weight of the shoe wearer is alternately imposed on and removed from the integrated layer and thereby alternately compressing and relaxing the pressure on the air trapped between the pistons of the integrated layer and the intermediate layer.

* * * * *